US006308648B1

(12) United States Patent
Burton et al.

(10) Patent No.: US 6,308,648 B1
(45) Date of Patent: Oct. 30, 2001

(54) METHOD OF MAKING LINED FABRIC PRODUCTS WITH AN OPEN HEM

(76) Inventors: Perry E. Burton, deceased, late of Easley, SC (US); Lois LaBoone, executor, 202 Haverhill Cir., Easley, SC (US) 29642; John V. Noonan, 106 Merrifield Ct., Greenville, SC (US) 29615

( * ) Notice: Subject to any disclaimer, the term of this patent is extended or adjusted under 35 U.S.C. 154(b) by 0 days.

(21) Appl. No.: 09/412,548

(22) Filed: Oct. 5, 1999

Related U.S. Application Data

(60) Provisional application No. 60/103,173, filed on Oct. 6, 1998.

(51) Int. Cl.[7] ..... D05B 35/02

(52) U.S. Cl. ..... 112/475.08; 112/141; 112/440

(58) Field of Search ..... 112/475.08, 475.01, 112/475.03, 475.06, 475.09, 141, 142, 149, 440, 441, 428

(56) References Cited

U.S. PATENT DOCUMENTS

| | | | | |
|---|---|---|---|---|
| 2,515,038 | * | 7/1950 | Harper | 112/428 X |
| 2,520,613 | * | 8/1950 | Robertson | 112/405 |
| 3,870,000 | * | 3/1975 | Castany Ferre et al. | 112/475.09 X |
| 4,292,908 | * | 10/1981 | Blessing | 112/141 X |
| 6,116,175 | * | 9/2000 | Ito | 12/475.09 |

* cited by examiner

*Primary Examiner*—Ismael Izaguirre
(74) *Attorney, Agent, or Firm*—Dority & Manning, P.A.

(57) ABSTRACT

The present invention is generally directed to a method of making a lined fabric product having an open hem construction. An open hem construction refers to a lined fabric product in which a liner fabric is hemmed separately from a cover fabric. In this configuration, the liner fabric is allowed to drape independently from the cover fabric. In the past, fabric articles, such as curtains and draperies, having an open hem construction were primarily made exclusively by hand. The process of the present invention, on the other hand, allows some automation, improving the speed and cost at which the products are made.

21 Claims, 4 Drawing Sheets

METHOD OF MAKING LINED FABRIC PRODUCTS WITH AN OPEN HEM

This application claims the benefit of priority from U.S. Provisional Patent Application No. 60/103,173, filed Oct. 6, 1998.

FIELD OF THE INVENTION

The present invention is generally directed to a method of making lined fabric products in which, at one end, a liner fabric is hemmed separately from a cover fabric. More particularly, the present invention is directed to a semi-automated process for producing lined fabric products, such as curtains and drapes, having an open hem or floating liner construction.

BACKGROUND OF THE INVENTION

Many fabric products, such as curtains, valances, and drapes, include a decorative cover fabric stitched to a liner fabric. The liner fabric, which is typically a lighter fabric than the cover fabric, is attached to the cover fabric for various reasons. For instance, when incorporated into curtains, the liner fabric adds weight to the curtain improving the drape characteristics. The liner fabric also improves the ability of the curtain to block out sunlight and other light rays. Further, the liner fabric generally serves to improve the overall aesthetic appearance of the cloth article.

One common manner in which lined curtains are made is to attach the liner fabric to the cover fabric along the top edges and the side edges, but not along the bottom edges. For instance, FIG. 1 illustrates a lined curtain product made in this manner. As shown, the liner fabric is hemmed to the cover fabric along each side edge and is sewn to the cover fabric along a top edge. The bottom edge of the liner fabric, however, is hemmed separately from the cover fabric. This arrangement is commonly referred to as an open hem construction.

Curtains having an open hem construction offer various advantages. For instance, an open hem construction, in many applications, improves the drape characteristics of the curtain. For instance, through the use of an open hem construction, the liner fabric is prevented from crimping or otherwise distorting the cover fabric when hung. The open hem construction allows the liner fabric to float independently of the cover fabric. For example, if the liner fabric were attached at every edge to the cover fabric, any irregularity may cause the liner fabric to react against the cover fabric adversely effecting the appearance of the curtain.

Currently, in making curtains with an open hem construction, the liner fabric and cover fabric, after being measured in size, are first hemmed separately along a bottom edge. Next, the side edges of the liner fabric and cover fabric are folded over and hemmed together. Finally, an appropriate header is sewn into the top of the curtain. The header, for instance, can be designed to accept a curtain rod or to mate with clips used to hang the curtain.

Unfortunately, the above described method for making curtains with open hem constructions is time consuming and is very labor intensive, escalating the costs of producing the fabric products. For example, most curtains and draperies of this type must be made almost entirely by hand. More particularly, the prior art is deficient in providing an automated or semi-automated process for manufacturing curtains and other lined fabric products that include an open hem construction. The above described method of making open hemmed curtains is simply not well adapted for use with automated fabric processing systems that are currently available in the marketplace.

SUMMARY OF THE INVENTION

The present invention recognizes and addresses the foregoing disadvantages, and others of prior art constructions and methods.

Accordingly, it is an object of the present invention to provide an improved method of making lined fabric products having an open hem construction.

It is another object of the present invention to provide a method for producing a lined fabric product with an open hem construction that can be done semi-automatically.

Another object of the present invention is to provide an efficient method for producing lined fabric products with an open hem construction that does not have to be done entirely by hand.

These and other objects of the present invention are achieved by providing a method of making a lined fabric product in which, at one end of the product, a liner fabric is hemmed separately from a cover fabric. The method includes the steps of providing a cover fabric and a superimposed liner fabric. The cover fabric and the liner fabric each include corresponding top edges, bottom edges, and a pair of opposing side edges. The cover fabric is attached to the liner fabric along each of the opposing side edges to form a first vertical hem and a second vertical hem.

Once the vertical hems have been formed, the method includes the steps of unraveling a portion of the first vertical hem and unraveling a portion of the second vertical hem. The vertical hems are unraveled adjacent the bottom edges of the liner fabric and the cover fabric. Once the vertical hems have been unraveled, a hem is formed along the bottom edge of the liner fabric and a separate hem is formed along the bottom edge of the cover fabric. The unraveled portions of the vertical hems can then be reattached in completing the open hem construction.

In one preferred embodiment, at least a portion of the above described method is automated using a fabric processing system. For instance, the cover fabric and the liner fabric can be fed together through a machine that automatically folds the side edges of the fabrics and forms the vertical hems. The method can further include the step of automatically sewing a particular header into the top of the fabric product.

In one embodiment, the first vertical hem and the second vertical hem of the fabric product are created by stitching together the side edges of the cover fabric and the liner fabric, forming a column of stitches extending along the side edges. The portions of the vertical hems that are unraveled are done by removing a portion of the stitches. Preferably, the column of stitches extending along the side edges are blind stitches. By using blind stitches, it becomes unnoticeable that a portion of the vertical hems have been sewn twice.

The lined fabric product made according to the above method can be, for instance, a curtain or a drapery. The hems formed along the bottom edges of the cover fabric and the liner fabric can be double backed hems. In one embodiment, the hem formed in the cover fabric can be wider than the hem formed in the liner fabric. If necessary, a bottom strip of the liner fabric can be cut off prior to forming the hem so that the liner fabric is shorter than the cover fabric.

These and other objects of the present invention are also achieved by providing a method of making a lined fabric product having an open hem construction. The method includes the steps of feeding a cover fabric and a liner fabric simultaneously into a folding and sewing device. The device folds over and sews together corresponding side edges of the cover fabric and the liner fabric. Specifically, the device forms the first vertical hem and a second vertical hem along the side edges. Each of the hems include a stitched line where the cover fabric and the liner fabric have been sewn together.

After the vertical hems have been formed, a portion of each vertical hem is unraveled adjacent the bottom edges of the liner fabric and the cover fabric. By unraveling a portion of the vertical hems, a hem can be formed along the bottom edge of the liner fabric and a separate hem can be formed along the bottom edge of the cover fabric. The unraveled portions of the vertical hems are then restitched together to form the open hem construction.

In one embodiment, the cover fabric fed to the folding and sewing device can be wider than the liner fabric. In this embodiment, the vertical hems can be formed by folding the side edges of the cover fabric over onto the liner fabric. In this manner, not as much fabric is used to form the lined fabric product.

Other objects, features and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying figures, in which.

Figure 1:
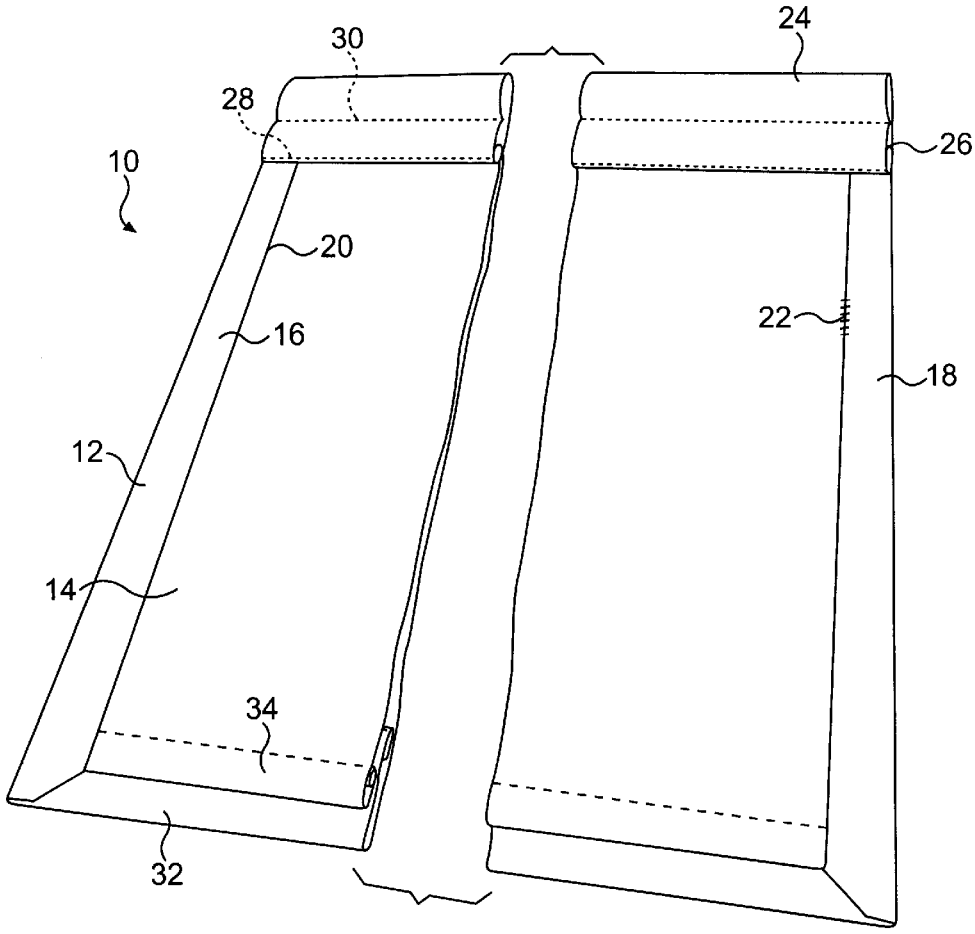
FIG. 1 is a perspective view of a curtain made in accordance with the present invention.

Repeat use of reference characters in the present specification and drawings is intended to represent same or analogous features or elements of the present invention.

DETAILED DESCRIPTION OF PREFERRED EMBODIMENTS

It is to be understood by one of ordinary skill in the art that the present discussion is a description of exemplary embodiments only and is not intended as limiting the broader aspects of the present invention, which broader aspects are embodied in the exemplary construction.

In general, the present invention is directed to a method for producing lined fabric products having an open hem or floating liner construction. Such products include curtains, draperies, valances, other window treatments, garments, and various other articles. For exemplary purposes, FIG. 1 illustrates a curtain generally 10 made in accordance with the present invention.

Specifically, FIG. 1 illustrates the back side of curtain 10. Curtain 10 includes a cover fabric 12 attached to a liner fabric 14. Cover fabric 12 is sewn to liner fabric 14 along a first vertical hem 16 by a column of stitches 20 and along a second vertical hem 18 by a column of stitches 22. Cover fabric 12 and liner fabric 14 are also sewn together at the top of curtain 10 by a row of stitches 28 which forms part of a header 24. Header 24 includes a second row of stitches 30 which forms a passage 26 for receiving a curtain rod or the like.

In accordance with the present invention, the bottom edge of cover fabric 12 and the bottom edge of liner fabric 14 are hemmed separately within curtain 10 to form an open hem construction. Specifically, cover fabric 12 includes a bottom hem 32, while liner fabric 14 includes a separate and distinct bottom hem 34. As shown in this embodiment, bottom hems 32 and 34 are formed by folding over and doubling back the fabric. As also shown in this embodiment, liner fabric 14 is generally shorter than cover fabric 12 and includes a narrower bottom hem 34 in comparison to bottom hem 32 of the cover fabric.

As mentioned above, curtains and other lined fabric products made with an open hem construction as illustrated in FIG. 1 offer various advantages and benefits. Most importantly, the open hem construction allows the liner fabric to "float" independently of the cover fabric, preventing the liner fabric from crimping the cover fabric and improving the drape characteristics of the cloth article. In accordance with the present invention, a new method has been discovered for producing fabric products with an open hem construction. The method of the present invention, which will be described in more detail hereinafter, allows the fabric product to be made faster, with less labor, and at a significant cost savings.

Figure 2:
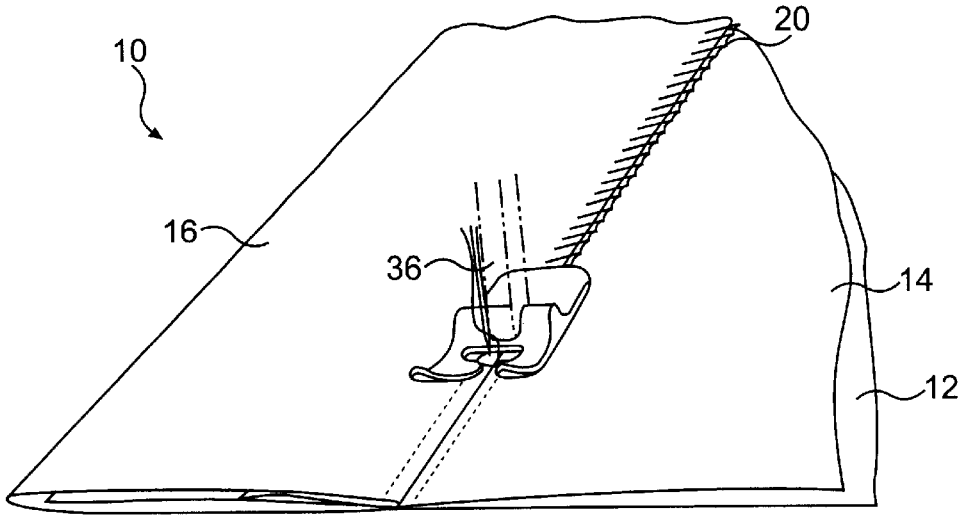
FIG. 2 is a perspective view with cutaway portions illustrating the formation of a vertical hem on a lined fabric product in accordance with the present invention.

The process of the present invention will now be described in detail with reference to FIGS. 2 through 5 which each exemplify each of the steps of the process with respect to the fabrication of curtain 10. Referring to FIG. 2, first, a suitable liner fabric 14 is superimposed upon a cover fabric 12. The side edges of cover fabric 12 and liner fabric 14 are folded over to form first vertical hem 16 and second vertical hem 18. As shown in FIG. 2, the side edge of cover fabric 12 can be folded over, double backed and stitched to liner fabric 14 using a sewing device 36. Sewing device 36 leaves a column of stitches 20, which preferably extend the entire length of cover fabric 12.

Thus, according to the process of the present invention, vertical hems 16 and 18 as shown in FIG. 1 can be formed prior to any other operation. This arrangement is contrary to conventional methods in which the bottom hems of the product are formed first. Because the vertical hems can be formed first according to the process of the present invention, instead of being done by hand, the vertical hems can be formed by an automated folding and sewing device.

For instance, such devices are disclosed in U.S. Pat. No. 5,572,940 entitled "Folding and Sewing Apparatus", which is incorporated herein by reference in its entirety, and in U.S. patent application Ser. No. 08/372,190 entitled "Level Lining Apparatus and Method" which is also incorporated herein by reference in its entirety. U.S. Pat. No. 5,572,940 and U.S. Ser. No. 08/372,190, which represent the present inventors' prior work, disclose various apparatuses and systems capable of performing numerous operations on a fabric as it is unwound from a roll.

In particular, U.S. Ser. No. 08/372,190 discloses a device designed to continuously and simultaneously feed a cover fabric and a liner fabric into a fabric processing system. U.S. Pat. No. 5,572,940, on the other hand, discloses a fabric processing system capable of automatically folding and sewing vertical hems into one or more sheets of fabric. The system disclosed in U.S. Pat. No. 5,572,940 also includes a cutting device capable of measuring and cutting fabric sheets into predetermined lengths after the vertical hems have been formed.

As such, the fabric processing systems and devices disclosed in the present inventors' prior works are well adapted to automatically form vertical hems 16 and 18 in curtain 10 as shown in FIGS. 1 and 2. It should be appreciated, however, that any suitable folding and sewing device or method of forming vertical hems may be used in the process of the present invention.

Figure 3:
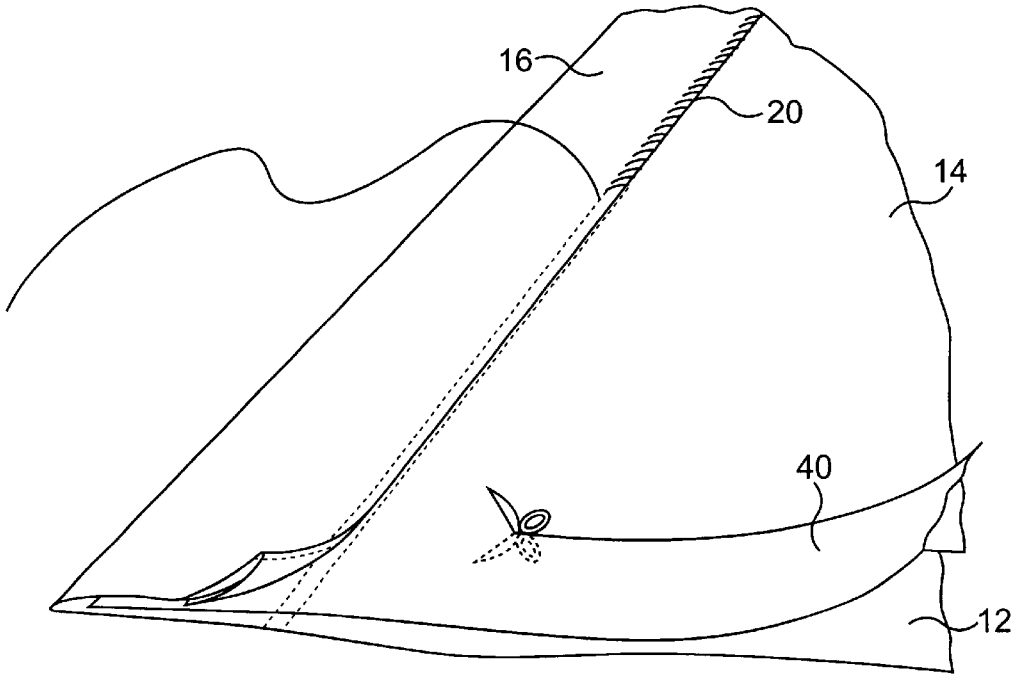
FIG. 3 is a perspective view with cutaway portions illustrating an unraveling step and a cutting step during the formation of a lined fabric product in accordance with the present invention.

In one embodiment of the present invention, as illustrated in FIGS. 2 and 3, liner fabric 14 can be narrower than cover fabric 12. In this manner, only the side edges of cover fabric 12 need to be folded over in forming vertical hems 16 and 18. Thus, the resulting hem is only four layers of fabric thick where sewn together.

In conventional fabric products, the liner fabric is typically the same width as the cover fabric. In this arrangement, when the vertical hems are formed, both the cover fabric and the liner fabric are folded together forming a double hem arrangement. Instead of only being 4 layers thick, a double folded hem is 6 layers of fabric thick. Thus, by using a liner fabric that is narrower than the cover fabric, not only is less material used, but two layers of fabric are eliminated from the vertical hems. This result is particularly significant when, as shown in FIG. 1, the bottom and top of the vertical hems are also hemmed or stitched to other fabric layers.

For example, as shown in FIG. 1, at the bottom of curtain 10, stitches 20 not only form vertical hem 16 but also attach vertical hem 16 to bottom hems 34 and 32. Where bottom hems 34 and 32 intersect vertical hem 16, stitches 20 may have to penetrate up to 4 additional layers of fabric, significantly adding to the total thickness of the fabric article in those areas.

There are many advantages to reducing the number of fabric layers used to construct vertical hems 16 and 18. For instance, each layer added to each hem makes it more difficult to sew the hem together. Increasing the number of layers that are present makes it harder to force a needle into the fabric, generates more heat between the fabric and the needle and increases the likelihood of needle breakage. Further, thicker hems can adversely interfere with the appearance of the product. For instance, when included in a curtain or drapery, a thicker hem may not hang correctly.

Any suitable stitching can be used to construct vertical hems 16 and 18. In one preferred embodiment, blind stitches are used to form the hems. Blind stitches are stitches that are only visible from one side of the fabric product. In other applications, however, other types of stitching may be preferred.

Once vertical hems 16 and 18 are formed and cover fabric 12 and liner fabric 14 are cut to a predetermined length, a portion of stitches 20 and stitches 22 are removed in order to form bottom hems 32 and 34. FIG. 3, for instance, illustrates the removal of a portion of stitches 20. In most applications, when forming curtains or draperies, only about 6 inches of stitches 20 need to be removed. When using blind stitches, a loop formed in the thread can be clipped allowing the removal of a portion of the line of stitches without causing the remainder of the stitches to unravel.

If desired, once a portion of stitches 20 and 22 are unraveled, a bottom strip 40 can be trimmed off liner fabric 14 as shown in FIG. 3. Bottom strip 40 can be removed from liner fabric 14 so that the liner fabric is shorter than cover fabric 12 and is not visible from the reverse side of curtain 10. Also, as shown in FIG. 1, bottom hem 32 formed into cover fabric 12 is typically wider than bottom hem 34 formed into liner fabric 14, which further makes it necessary to trim off bottom strip 40 in order to make liner fabric 14 shorter or the same length as cover fabric 12.

As shown in FIG. 3, bottom strip 40 can be trimmed off of liner fabric 14 using a pair of scissors. Any suitable cutting instrument, however, may be used.

Figure 4:
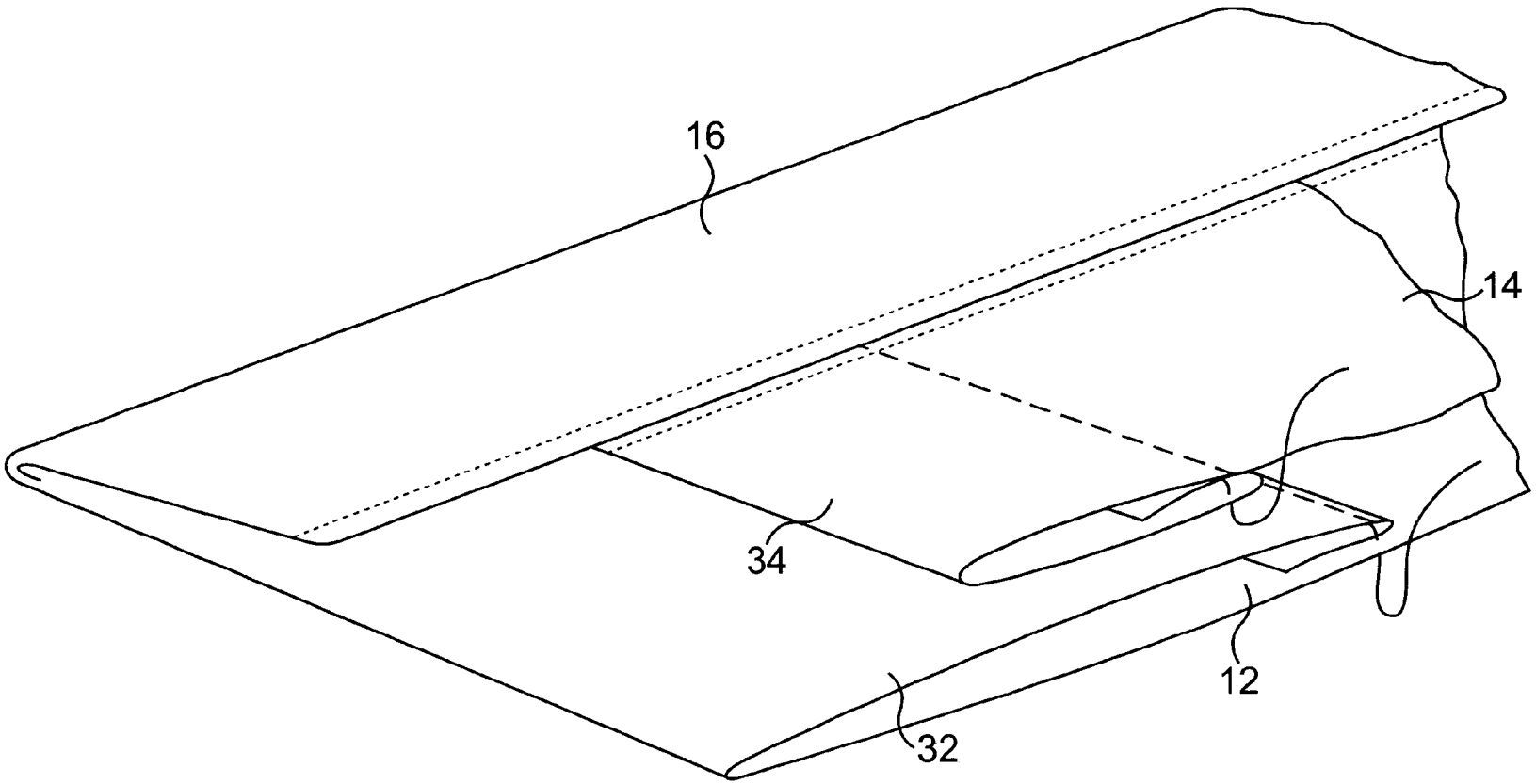
FIG. 4 is a perspective view with cutaway portions illustrating the formation of two separate hems formed in accordance with the present invention.

Referring to FIG. 4, once a portion of stitches 20 and 22 are removed, bottom hem 32 can be formed in cover fabric 12 and bottom hem 34 can be formed in liner fabric 14. As shown, bottom hems 32 and 34 are typically double backed hems, in which the edge of the fabric is folded twice. As described above, bottom hem 32, when producing curtains and draperies, is typically wider than bottom hem 34. As also illustrated in FIG. 4, when a portion of the liner fabric is trimmed off as shown in FIG. 3, cover fabric 12 becomes longer than liner fabric 14.

Figure 5:
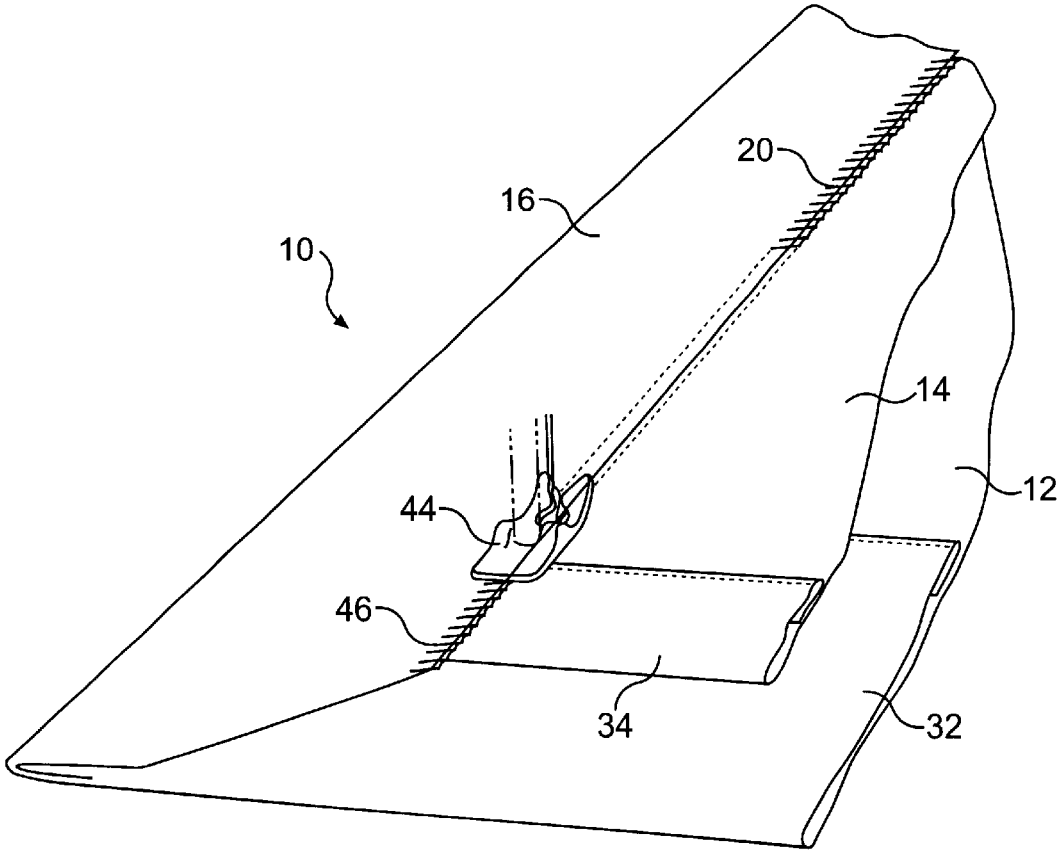
FIG. 5 is a perspective view with cutaway portions of a restitching operation performed to complete a lined fabric product made in accordance with the present invention.

After bottom hems 34 and 32 have been formed, such as by sewing, vertical hems 16 and 18 are restitched as shown in FIG. 5, thus completing the open hem construction. As illustrated, vertical hem 16 can be restitched using a sewing device 44, which forms a column of stitches 46. Preferably, column of stitches 46 are of the same type of stitches used to construct column of stitches 20.

Referring back to FIG. 1, after forming the open hem as described above or prior to forming the open hem, a header 24 can be formed into curtain 10 at the top. As mentioned above, header 24 in this embodiment is adapted to receive a curtain rod. Any type of header, however, can be incorporated into curtain 10.

Besides the manufacture of lined curtains as illustrated in FIGS. 1 through 5, the process of the present invention is generally well adapted to making any fabric product having an open hem construction. For instance, the process of the present invention can be used to form draperies, valances, other window treatments and various garments. Of particular advantage, the above described method allows the fabric products to be manufactured with at least some automation, by taking advantage of some of the fabric processing systems currently available in the market. Specifically, the process of the present invention is well adapted for use with fabric processing systems that simultaneously feed two fabrics together from separate rolls of material and which automatically form vertical hems in the fabric layers. These automated fabric processing systems also measure and cut the hemmed fabrics to a predetermined length. Once cut, the remainder of the steps as illustrated in FIGS. 3 through 5 can then be performed to complete the open hem construction.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention.

What is claimed is:

1. A method of making a lined fabric product in which, at one end of said product, a liner fabric is hemmed separately from a cover fabric, said method comprising the following steps:

providing a cover fabric and a superimposed liner fabric, each of said cover fabric and said liner fabric including corresponding top edges, bottom edges and a pair of opposing side edges, said cover fabric being attached to said liner fabric along each of said opposing side edges to form a first vertical hem and a second vertical hem;

detaching a portion of said first vertical hem and a portion of said second vertical hem adjacent said bottom edges of said liner fabric and said cover fabric;

forming a hem along said bottom edge of said liner fabric and a separate hem along said bottom edge of said cover fabric; and reattaching said detached portions of said first vertical hem and said second vertical hem.

2. A method as defined in claim 1, wherein said first vertical hem and said second vertical hem are created by stitching together said side edges of said cover fabric and said liner fabric forming a column of stitches extending along each of said side edges.

3. A method as defined in claim 2, wherein said portion of said first vertical hem and said portion of said second vertical hem are detached by unraveling a portion of said column of stitches extending along said side edges.

4. A method as defined in claim 2, wherein said column of stitches extending along said side edges are blind stitches.

5. A method as defined in claim 1, further comprising the step of cutting off a bottom strip of said liner fabric prior to forming said hem along said bottom edge of said liner fabric.

6. A method as defined in claim 1, wherein said fabric product is a curtain.

7. A method as defined in claim 1, wherein said cover fabric is wider than said liner fabric, and wherein said first vertical hem and said second vertical hem are formed by folding said side edges of said cover fabric over on to said liner fabric.

8. A method of making a lined fabric product in which, at one end of said product, a liner fabric is hemmed separately from a cover fabric, said method comprising the following steps:

providing a cover fabric and a liner fabric, said liner fabric being superimposed on said cover fabric, said fabrics each including a top edge, a pair of opposing side edges, and a bottom edge;

attaching said cover fabric to said liner fabric along each of said opposing side edges to form a first vertical hem and a second vertical hem, said side edges being attached together by a column of stitches;

unraveling a portion of said first vertical hem and said second vertical hem adjacent to said bottom edges of said liner fabric and said cover fabric;

forming a hem along said bottom edge of said liner fabric and a separate hem along said bottom edge of said cover fabric; and reattaching said unraveled portions of said first vertical hem and said second vertical hem.

9. A method as defined in claim 8, wherein said column of stitches are blind stitches.

10. A method as defined in claim 8, wherein said hem formed along said bottom edge of said cover fabric and said hem formed along said bottom edge of said liner fabric are doubled back hems.

11. A method as defined in claim 8, further comprising the step of cutting off a bottom strip of said liner fabric prior to forming said hem along said bottom edge of said liner fabric.

12. A method as defined in claim 8, wherein said hem formed along said bottom edge of said cover fabric is wider than said hem formed along said bottom edge of said liner fabric.

13. A method as defined in claim 8, wherein said fabric product is a curtain.

14. A method as defined in claim 8, wherein said unraveled portions of said first vertical hem and said second vertical hem are reattached by stitching said hems together.

15. A method as defined in claim 8, wherein said cover fabric is wider than said liner fabric, and wherein said first vertical hem and said second vertical hem are formed by folding said side edges of said cover fabric over on to said liner fabric.

16. A method of making a lined fabric product in which, at one end of said product, a liner fabric is hemmed separately from a cover fabric, said method comprising the following steps:

feeding a cover fabric and a liner fabric simultaneously into a folding and sewing device, said device folding over and sewing together corresponding side edges of said cover fabric and said liner fabric, said device forming a first vertical hem and a second vertical hem along said side edges, each of said hems including a stitch line where said cover fabric and said liner fabric have been sewn together;

unraveling a portion of said stitch line of said first vertical hem and a portion of said stitch line of said second vertical hem adjacent to a bottom edge of said cover fabric and said liner fabric;

forming a hem along said bottom edge of said liner fabric and a separate hem along said bottom edge of said cover fabric; and restitching said unraveled portions of said stitch lines of said first vertical hem and said second vertical hem.

17. A method as defined in claim 16, wherein said cover fabric is fed from a first roll of material and a liner fabric is fed from a second roll of material into said folding and sewing device.

18. A method as defined in claim 17, further comprising the step of transversely cutting said cover fabric and said liner fabric to a pre-determined length after said first vertical hem and said second vertical hem have been formed.

19. A method as defined in claim 16, further comprising the step of cutting off a bottom strip of said liner fabric prior to forming said hem along said bottom edge of said liner fabric.

20. A method as defined in claim 16, wherein said stitch lines comprise blind stitches.

21. A lined fabric product comprising:

a face fabric having a first vertical hem located along a first vertical edge and a second vertical hem located along a second and opposite vertical edge, said hems being created by folding said vertical edges at least once thereby creating vertical fold lines at said respective edges;

said sewn product further comprising a liner fabric, said liner fabric being superimposed on said face fabric and being sewn to said face fabric at least at said vertical hems, said liner fabric having a width that is narrower than the width of said face fabric, said width being about the distance between the innermost and opposite fold lines for decreasing the thickness of said vertical hems.

* * * * *